US009378885B2

(12) United States Patent
Hongzhong et al.

(10) Patent No.: US 9,378,885 B2
(45) Date of Patent: Jun. 28, 2016

(54) FLAT COIL WINDINGS, AND INDUCTIVE DEVICES AND ELECTRONICS ASSEMBLIES THAT UTILIZE FLAT COIL WINDINGS

(71) Applicant: Pulse Electronics, Inc., San Diego, CA (US)

(72) Inventors: Ma Hongzhong, Zhuhai (CN); Robert Lu, Zhuhai (CN)

(73) Assignee: Pulse Electronics, Inc., San Diego, CA (US)

( * ) Notice: Subject to any disclaimer, the term of this patent is extended or adjusted under 35 U.S.C. 154(b) by 0 days.

(21) Appl. No.: 13/802,033

(22) Filed: Mar. 13, 2013

(65) Prior Publication Data

US 2013/0278371 A1 Oct. 24, 2013

Related U.S. Application Data

(60) Provisional application No. 61/616,240, filed on Mar. 27, 2012.

(51) Int. Cl.

| | |
|---|---|
| ***H01F 27/29*** | (2006.01) |
| ***H01F 27/24*** | (2006.01) |
| ***H01F 27/06*** | (2006.01) |
| ***H01F 27/28*** | (2006.01) |
| ***H01F 5/00*** | (2006.01) |

(52) U.S. Cl.

CPC ..... *H01F 27/2871* (2013.01); *H01F 5/00* (2013.01); *H01F 27/2852* (2013.01); *H01F 27/292* (2013.01)

(58) Field of Classification Search

USPC ..... 336/192, 232, 170, 212, 65–68, 220, 336/221, 182

See application file for complete search history.

(56) References Cited

U.S. PATENT DOCUMENTS

| | | | | |
|---|---|---|---|---|
| 4,901,048 | A * | 2/1990 | Williamson | 336/180 |
| 5,179,365 | A * | 1/1993 | Raggi | 336/65 |
| 5,345,670 | A * | 9/1994 | Pitzele et al. | 29/606 |
| 5,760,669 | A * | 6/1998 | Dangler et al. | 336/65 |
| 6,335,671 | B1 * | 1/2002 | Roessler et al. | 336/65 |
| 6,642,827 | B1 | 11/2003 | McWilliams et al. | |
| 7,129,809 | B2 | 10/2006 | Estrov et al. | |
| 7,948,344 | B2 | 5/2011 | Kaneko | |
| 7,994,891 | B2 | 8/2011 | Wedley | |
| 8,368,500 | B2 * | 2/2013 | Gilmartin et al. | 336/192 |
| 8,471,666 | B2 * | 6/2013 | Kaneko | 336/198 |
| 2003/0218527 | A1 | 11/2003 | Okamoto | |
| 2004/0007933 | A1 | 1/2004 | Hsu et al. | |

(Continued)

FOREIGN PATENT DOCUMENTS

| | | |
|---|---|---|
| CN | 101651025 A | 2/2010 |
| EP | 1752997 | 10/2010 |

(Continued)

*Primary Examiner* — Mangtin Lian

(74) *Attorney, Agent, or Firm* — Gazdzinski & Associates PC

(57) ABSTRACT

A low cost, reduced form factor, high performance electronic device for use in electronic circuits and methods. In one exemplary embodiment, the device includes a unitary header assembly construction that ensures device coplanarity and also includes vertically oriented terminal pins. The device utilizes preconfigured flat coil windings that are disposed directly within a planar core. The flat coil windings further include features that are configured to mate with the header assembly terminal pins which substantially simplify the manufacturing process. Methods for manufacturing the device are also disclosed.

15 Claims, 7 Drawing Sheets

(56) References Cited

U.S. PATENT DOCUMENTS

| | | | | |
|---|---|---|---|---|
| 2004/0257190 | A1 | 12/2004 | Peck et al. | |
| 2009/0278648 | A1 * | 11/2009 | Teng et al. | 336/199 |
| 2011/0090039 | A1 | 4/2011 | Dziubek et al. | |
| 2012/0056704 | A1 | 3/2012 | Nagano et al. | |

FOREIGN PATENT DOCUMENTS

| | | | |
|---|---|---|---|
| EP | 1752997 | B1 | 10/2010 |
| JP | 7-245217 | A | 9/1995 |
| JP | 2002-57045 | A | 2/2002 |
| JP | 2008-205212 | A | 9/2008 |

* cited by examiner

FLAT COIL WINDINGS, AND INDUCTIVE DEVICES AND ELECTRONICS ASSEMBLIES THAT UTILIZE FLAT COIL WINDINGS

PRIORITY

This application claims priority to co-owned U.S. Provisional Patent Application Ser. No. 61/616,240 filed Mar. 27, 2012 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to circuit elements, and more particularly in one exemplary aspect to inductive devices for use in e.g., power transformer applications, and methods of utilizing and manufacturing the same.

DESCRIPTION OF RELATED TECHNOLOGY

A myriad of different configurations of inductive electronic devices are known in the prior art. Many traditional inductive components, such as transformers, utilize primary and secondary windings made from conductors which are insulated from one another. The voltage applied to the primary winding dictates the voltage generated in the secondary winding based on the wire turn ratio between the primary and secondary windings. However, due to ever increasing needs for reductions in component size and cost of manufacturing, so-called planar inductive devices that utilize printed circuit board (PCB) technology have become popular design implementations for forming inductive devices such as transformers.

One such example of a prior art planar inductive device is illustrated in FIG. 1. The planar inductive device illustrated in FIG. 1 is a planar transformer that is typically used in power supply applications or other circuits that require current isolation. The inductive device of FIG. 1 utilizes core elements formed from a magnetically permeable material, such as ferrite, with planar PCB substrate(s) sandwiched therebetween. The planar PCB substrate is typically constructed from an epoxy/fiberglass laminate substrate that is clad with a sheet of copper between adjacent layers. The sheet of copper is configured to form the spiral traces, which form the windings for the device. The primary and secondary windings may be constructed in the same PCB substrate, or may be contained in separate PCB substrate assemblies. Through-hole vias are drilled into the planar PCB substrate(s) at the winding ends of the spiral traces to give access to other layer(s), as well as to the terminal pins of the device. The terminal pins are used to provide an electrical interface with an external device, such as a power supply printed circuit board.

While the device in FIG. 1 has been recognized by the industry as adequate in performing its respective mechanical and electrical functions, the device in FIG. 1 is relatively difficult to manufacture due at least in part to relatively large variations in co-planarity between PCB substrates.

For example, in cases where the primary and secondary windings are contained in separate PCB substrates, care needs to be taken to properly monitor substrate coplanarity, as large variations in coplanarity can degrade the electrical performance of the device due to, inter alia, increased leakage inductance. Furthermore, the use of thin layers of copper cladding in PCB substrates negatively affects the DC resistance due to the limited amount of conductive material available in which the current can pass. Increased DC resistance causes the inductive device to generate additional heat during operation, especially in power applications where planar transformers are typically used.

In addition, the use of extra material and manufacturing processes, as compared with prior art winding processes, can result in increased material and labor costs as well as increased manufacturing complexity for the device.

Accordingly, there remains a salient need for inductive devices that are less costly and easier to manufacture, such lower cost being enabled by, inter dice, addressing the difficulties associated with prior art planar inductive devices.

SUMMARY

In a first aspect, an inductive device is disclosed. In one embodiment, the device includes: a header assembly comprising a plurality of terminals; at least one core; and one or more flat coil windings disposed in proximity to the at least one core and electrically coupled with respective ones of the terminals.

In a second aspect, a header for use with an inductive device is disclosed.

In a third aspect, a "flat" winding for use in e.g., an inductive device is disclosed. In one embodiment, the winding includes: a metal winding comprising a width and a thickness, the width being greater in dimension than the thickness; wherein the metal winding is wound into a spiral characterized by an inner radius and an outer radius where the difference between the outer radius and the inner radius is the width.

In a fourth aspect, an electronics component assembly is disclosed. In one embodiment, the assembly includes: a power source; a printed circuit board; and an inductive device mounted on the printed circuit board that is in electrical communication with the power source. In one variant, the inductive device comprises: a header assembly comprising a plurality of terminals; at least one core; and one or more flat coil windings disposed in proximity to the at least one core and electrically coupled with respective ones of the terminals.

In a fifth aspect, a method of manufacturing an inductive device is disclosed.

In a sixth aspect, a method of operating an inductive device is disclosed.

In a seventh aspect, a method of reducing the cost of manufacturing an inductive device is disclosed.

In an eighth aspect, a method of increasing the consistency and/or reliability of an inductive device is disclosed.

BRIEF DESCRIPTION OF THE DRAWINGS

The features, objectives, and advantages of the disclosure will become more apparent from the detailed description set forth below when taken in conjunction with the drawings, wherein.

Figure 1:
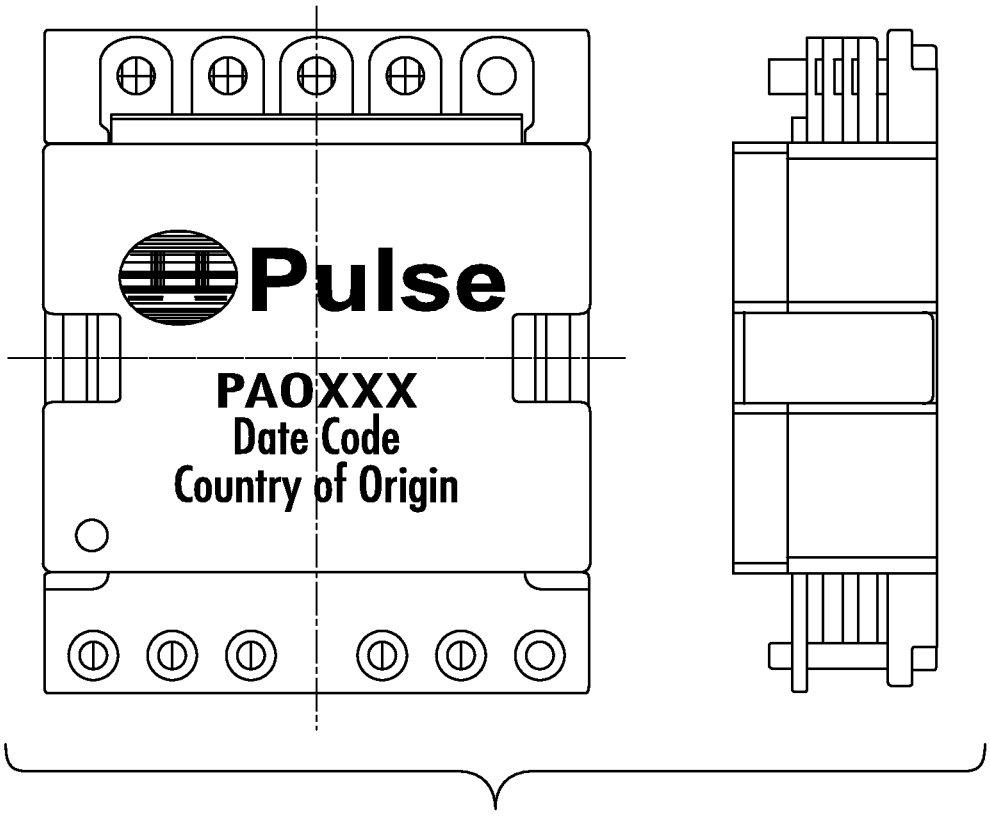
FIG. 1 PRIOR ART
FIG. 1 is a plan view of a prior art planar transformer.

All Figures disclosed herein are © Copyright 2012-2013 Pulse Electronics, Inc. All rights reserved.

DETAILED DESCRIPTION

Reference is now made to the drawings wherein like numerals refer to like parts throughout.

As used herein, the terms "bobbin", "form" (or "former") and "winding post" are used without limitation to refer to any structure or component(s) external to the windings themselves that are disposed on or within or as part of an inductive device which helps form or maintain one or more windings of the device.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

As used herein, the term "inductive device" refers to any device using or implementing induction including, without limitation, inductors, transformers, and inductive reactors (or "choke coils").

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Overview

The present disclosure provides, inter alia, an improved low cost inductive device, and methods for manufacturing and utilizing the same. Embodiments of the improved inductive device described herein are adapted to overcome the disabilities of the prior art by providing a simplified inductive device configuration which eliminate the need to use PCB substrates. Instead, embodiments of the present disclosure use wound flat coils that are disposed directly within the planar core. Advantageously, the flat coils can also be configured to contain terminal apertures that are formed to mate to corresponding post pins resident on the header assembly. The use of these terminal apertures on the flat coil windings simplify the assembly process resulting in lower manufacturing costs and lower overall product costs over prior art assembly techniques.

In addition, the use of flat coils in place of printed circuit board substrates improves the DC resistance characteristics of the inductive device. Exemplary embodiments of the device are also adapted for ready use by automated packaging equipment such as pick-and-place equipment and other similar automated manufacturing devices.

Various embodiments of the present disclosure address one or more of the deficiencies cited previously herein; e.g., they minimize the use of additional substrate material, simplify the manufacturing process, and/or maintain co-planarity between windings during manufacture, etc.), while simultaneously offering improved or at least comparable electrical performance over prior art planar inductive devices.

Embodiments of the disclosure also advantageously provide a high level of consistency and reliability of performance by limiting opportunities for errors or other imperfections during the manufacture of the device.

DETAILED DESCRIPTION OF EXEMPLARY EMBODIMENTS

Detailed descriptions of the various embodiments and variants of the apparatus and methods of the disclosure are now provided. While primarily discussed in the context of inductive devices used in e.g., power transformer applications, the various apparatus and methodologies discussed herein are not so limited. In fact, many of the apparatus and methodologies described herein are useful in the manufacture of any number of electronic or signal conditioning components that can benefit from the simplified manufacturing methodologies and apparatus, and improved consistency and reliability, described herein.

In addition, it is further appreciated that certain features discussed with respect to specific embodiments can, in many instances, be readily adapted for use in one or more other contemplated embodiments that are described herein. It can be readily recognized by one of ordinary skill, given the present disclosure that many of the features described herein possess broader utility outside of the specific examples and implementations with which they are described.

Inductive Device—

Figure 2:
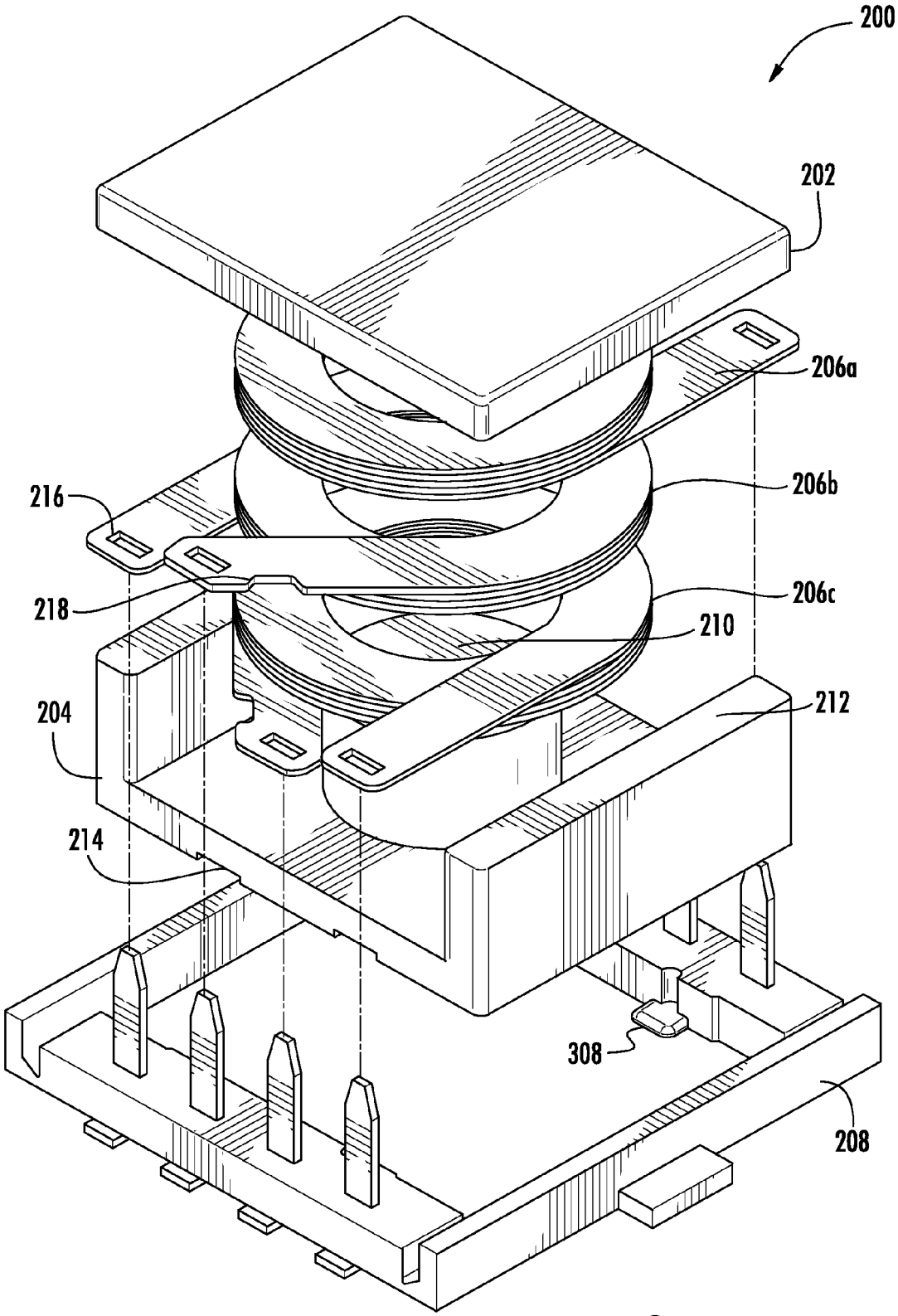
FIG. 2 is an exploded perspective view of an inductive device in accordance with one embodiment of the present disclosure.

Referring now to FIG. 2, a first exemplary embodiment of an inductive device 200 in accordance with the principles of the present disclosure is shown and described in detail. The inductive device as illustrated includes an upper core element 202 and a lower core element 204, flat coil windings 206, and a header assembly 208. The flat coil windings 206 are preferably preformed prior to being received on the center post 210 of the lower core element 204. It will be appreciated that as used herein, the term "flat" includes windings and other components which have at least one substantially planar side, and the team in no way connotes any particular thickness or height.

Additionally, the flat coil windings 206 are configured to be self-aligning when installed onto the header assembly 208 of the inductive device 200, thereby obviating the need for complex assembly fixtures and assembly processes. Furthermore, the tolerances associated with the flat coil windings are very precise and repeatable thereby resulting in, inter alia, improved winding coplanarity over prior art planar inductive devices that utilize printed circuit board substrates (see, for example, FIG. 1).

The lower core element 204 as illustrated includes a flat bottom surface, while the opposing interior surface includes two riser elements 212 and a cylindrical center post element 210 that protrudes from the geometric center of the lower core element. The riser elements are located at opposing edges and run the entire width of the lower core element. The center post element is configured to have the same height as the riser elements; however it is also envisioned that in certain embodiments, it may be desirable to include a reduced height for the center post (thereby creating a gap that allows for adjustment of the inductive characteristics of the device). The lower core element also, in the illustrated embodiment, includes alignment features 214 that are configured to mate with respective standoff elements 308 present on the header assembly.

The upper core element 202, in the illustrated embodiment, is configured with flat external surfaces. The length and width dimensions of the upper core element are sized so as to match the respective dimensions of the lower core element. While a specific configuration is shown, it is appreciated that the illustrated configuration is merely exemplary. For example, the upper and lower core element configurations could be swapped such that the lower core element is now the upper core while the upper core element becomes the lower core. Further core configurations, such as those described in co-owned U.S. Pat. No. 7,994,891 filed Oct. 1, 2009 and entitled "Stacked Inductive Device Assemblies and Methods", the contents of which are incorporated herein by reference in its entirety, could also be readily substituted in alternative embodiments.

The device 200 further includes a number of "flat" coil windings 206. The flat coil windings in this implementation are formed from metal flat wire stock that is wound onto a mandrel, and subsequently coated with a nonconductive material to provide electrical isolation between adjacent layers when formed into a coil, although other techniques of formation may be used with equal success. Once such exemplary method of providing electrical isolation is disclosed in co-owned U.S. Pat. No. 6,642,827 issued on Nov. 4, 2003 and entitled "Advanced electronic microminiature coil and method of manufacturing", the contents of which are incorporated herein by reference in their entirety. When wound onto the mandrel, the flat coil windings are formed into a compressed spiral loop where the number of loops is associated with the number of turns for the inductive device. The loop size for the flat coil winding is also variable although, in the illustrated embodiment, chosen so as to be of a sufficient size in order to receive the center post of the lower core element.

In the embodiment of FIG. 2, the inductive device 200 includes three flat coil windings with one primary winding and two different secondary windings. Other variants that include one or more flat coil windings are of course also possible. In addition to having a single flat coil winding or multiple flat coil windings, each flat coil winding can also be varied so as to have a differing number of turns associated with it. For example, the primary flat coil winding might consist of ten (10) turns, while an associated secondary winding might only have five (5).

In addition to varying the number of flat coil windings and the number of turns within a given winding, the size of the windings can also be varied. For example, the primary winding could have a given width and thickness associated with that primary winding while the secondary winding might have the same thickness as the primary winding but have a differing width. Such a configuration might, for example, vary the capacitive characteristics of the underlying inductive device by varying the amount of overlap between a given primary winding and a given secondary winding.

Furthermore, the placement of the flat coil windings can also be varied. For example, while the windings illustrated in FIG. 2 are positioned discretely from one another, the windings themselves could also be interleaved by, for example, winding the primary and secondary flat coil windings concurrently such that layers between the windings are interleaved between turns of the inductive device.

The ends of the flat coil windings are further modified to include terminal apertures 216. The terminal apertures 216 are configured to accept the terminal pins 306 of the header assembly 208. The use of terminal apertures within the flat coil windings aids in maintaining the positioning of the flat coil windings. By using the terminal apertures 216, in conjunction with the terminal pins of the header assembly, the flat coil windings 206 are substantially self-aligned into the proper position within the device 200.

In addition, the bonding process between the flat coil windings and the header assembly is simplified through the use of terminal apertures as the flat coil windings can be directly bonded to the terminals via standard soldering operations such as solder reflow, solder dipping, hand soldering, resistance welding, etc.

Additional modifications to the flat coil windings are also envisioned, such as the exemplary terminal notches 218 illustrated in FIG. 2. These notches provide extra clearance between the flat coil winding ends and the neighboring terminal pins, which is useful in, for example, reducing high voltage potential shorting. In addition, the use of terminal notches beneficially reduces the size of the device 200 by allowing the terminal pins to be spaced more closely together than would otherwise be possible without these notches. Moreover, the flat coil windings may include keying features (not shown) that are used to properly align the respective windings when stacked together. Use of the keying features simplifies the manufacturing process by reducing the need to adjust the positioning of the flat coil windings when installing the inductive device in the header assembly.

Figure 3:
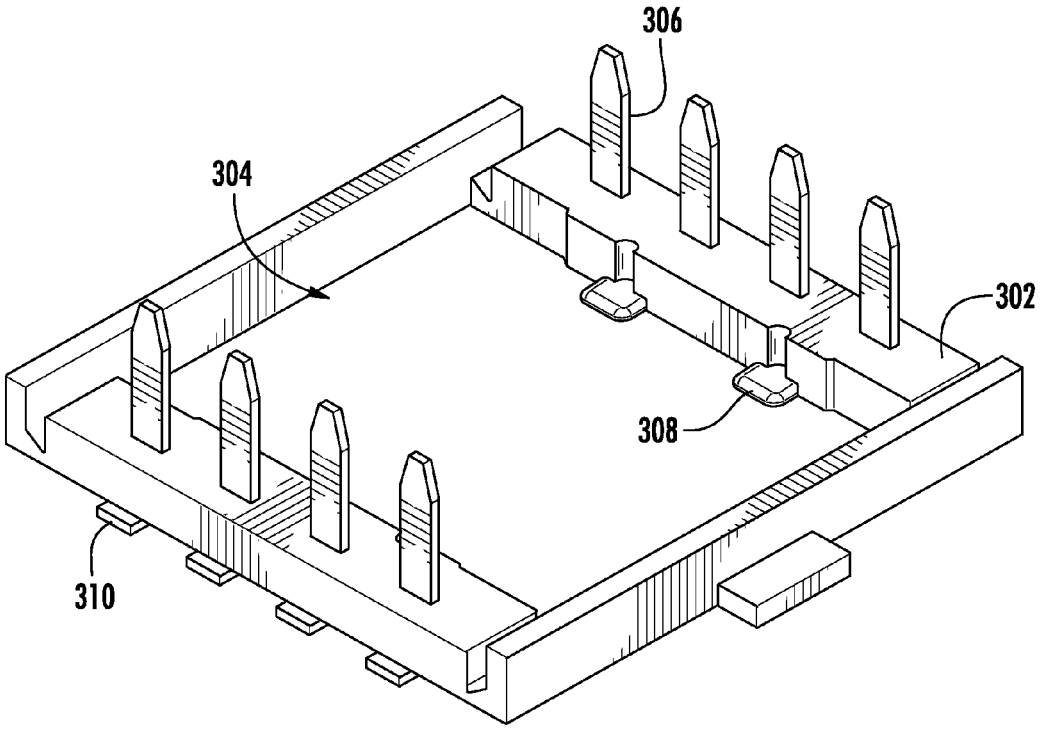
FIG. 3 is a perspective view of the header assembly illustrated in FIG. 2.

Referring now to FIG. 3, an exemplary embodiment of the header assembly 208 for use with the inductive device of FIG. 2 is shown and described in detail. The header body 302 is preferably formed from an injection molded polymer. The header body in the illustrated embodiment includes a center cavity 304 designed to accommodate the lower core element. By sizing the center cavity to a dimension just larger than the lower core element, the lower core element is properly positioned within the header assembly so as to ultimately facilitate the self-alignment of the flat coil windings with the terminal pins 306. Standoff elements 308, as discussed previously, may also advantageously be included in order to help retain the lower core element in the header body.

The terminal pins 306 are preferably constructed from a copper-based alloy material that is preferably compliant with the restriction of hazardous substances directive (RoHS). The terminal pins are preferably insert molded into the header body, i.e. they are placed into the header body during the molding process. While insert molded terminals are exemplary, post inserting processes (i.e. after molding process) can also be readily utilized. The terminals pins are also sized so as to mate with respective terminal apertures 216 present on the flat coil windings 206. The terminals also include a tapered end that facilitates insertion of the flat coil windings onto the terminals. The bottom of the vertical terminal pins are also formed at an approximate 90-degree angle to create a surface mount terminal 310, although other interfaces for the terminal pins, such as through hole terminals, could be readily substituted if desired.

Figure 4:
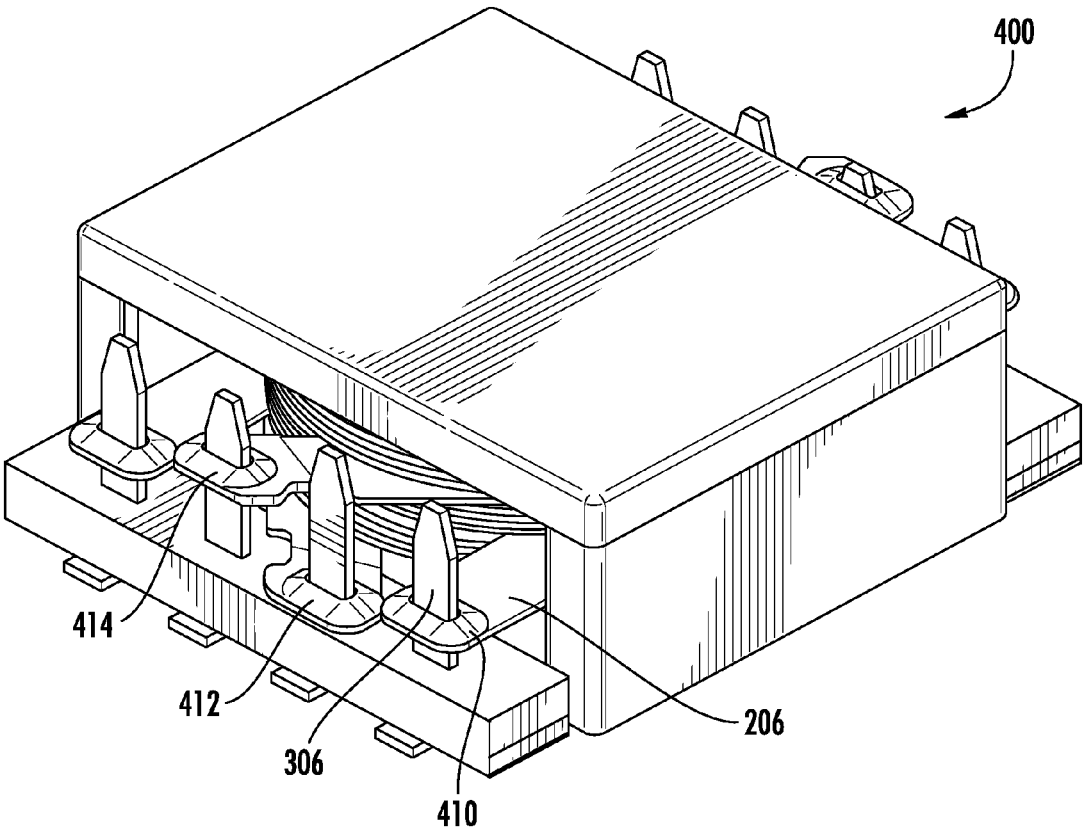
FIG. 4 is a perspective view of the inductive device in FIG. 2.

Referring now to FIG. 4, an embodiment of an assembled inductive device 400 is shown and described in detail. As discussed previously, the flat coil windings 206 are installed on the center post of the lower core element and aligned so that the terminal apertures mate with their respective terminal pins 306 of the header assembly. The flat coil windings and the terminal pins are subsequently bonded using soldering or other bonding methods (e.g. resistance welding, etc.). As can be seen in FIG. 4, the terminal connections 410 reside at varying levels of the terminal pins. Such a configuration is advantageous as the distance between adjacent terminal connections is maximized to prevent the device's resistance to high voltage potentials that can cause, inter alia, arcing/shorting between adjacent terminal pins. For example, note the large separation between second terminal connection 412 and the third terminal connection 414.

Figure 5:
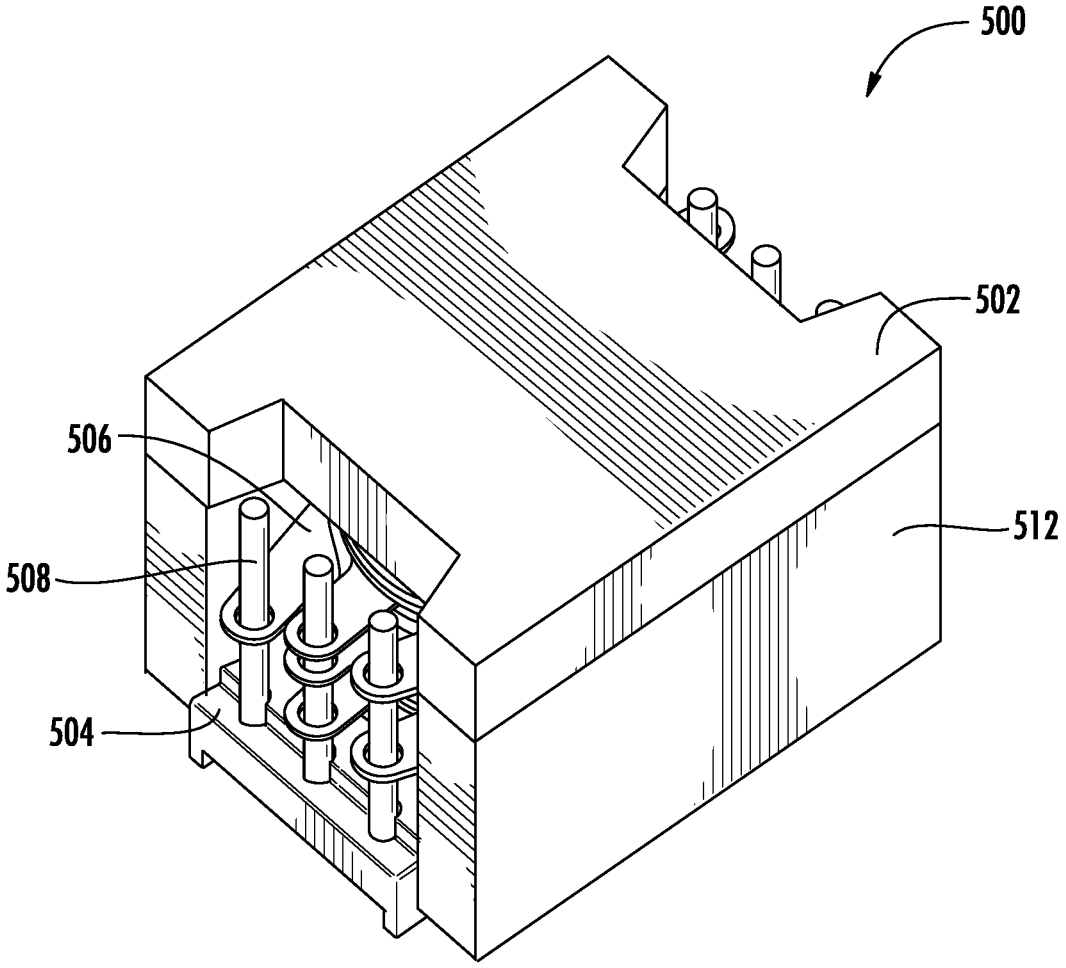
FIG. 5 is a perspective view of an inductive device in accordance with a second embodiment of the present disclosure.

Referring now to FIG. 5, a second exemplary embodiment of an inductive device 500 in accordance with the principles of the present disclosure is shown and described in detail. The inductive device as illustrated includes an upper core element 502 and a lower core element 512, flat coil windings 506, and a header assembly 504 with spool head pins 508. However, unlike the embodiment illustrated in FIGS. 2-4, the embodiment illustrated in FIG. 5 uses so-called "bat cores" for the upper and lower core elements. Such a configuration has advantages over that shown in, for example, FIG. 2 as the upper and lower core elements more fully utilize the footprint size of the inductive device. In fact, assuming an identical footprint to the inductive device illustrated in FIGS. 2-4, the inductive device of FIG. 5 increases the effective cross sectional area of the upper and lower core elements by approximately fifty percent (50%). Furthermore, the efficiency of the core illustrated in FIG. 5 is higher than that illustrated in FIGS. 2-4.

Figure 6:
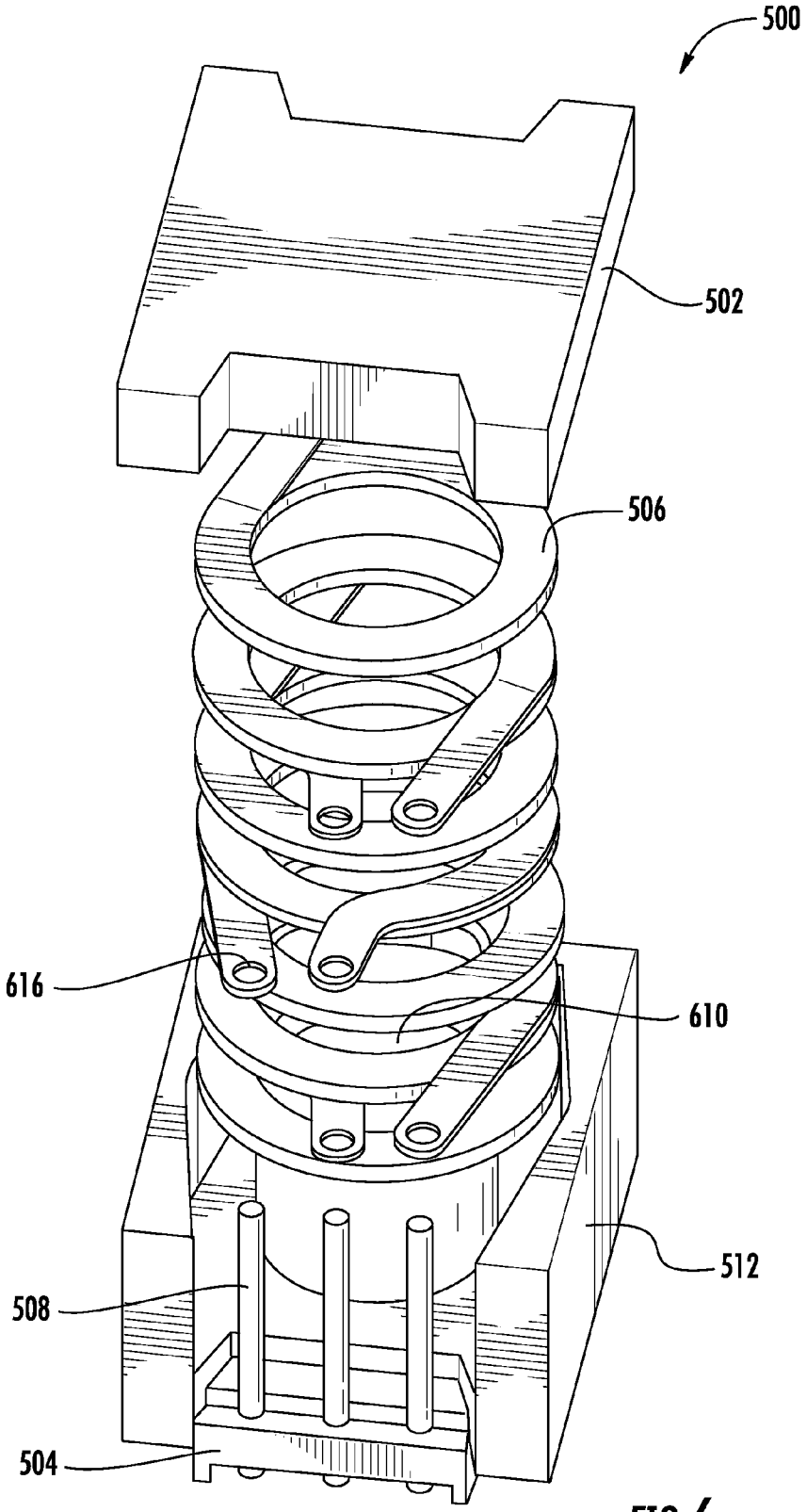
FIG. 6 is an exploded perspective view of the inductive device in FIG. 5.

Referring now to FIG. 6, an exploded perspective view of the inductive device 500 of FIG. 5 is illustrated so as to more clearly show the construction of the inductive device. Similar to that shown in FIGS. 2-4, the flat coil windings 506 are preferably preformed prior to being received on the center post 610 of the lower core element 512. It will be appreciated that as used herein, the term "flat" includes windings and other components which have at least one substantially planar side, and the term in no way connotes any particular thickness or height.

The flat coil windings in this implementation are formed from metal flat wire stock that is wound onto a mandrel, and subsequently coated with a nonconductive material to provide electrical isolation between adjacent layers when formed into a coil, although other techniques of formation may be used with equal success. In one embodiment, electrical isolation is provided in a similar fashion to that described with respect to FIGS. 2-4 above. Alternatively, appropriately cut or punched sheets of non-conductive sheet material (e.g. Kapton™ tape) are disposed between adjacent windings in order to provide the appropriate level of electrical isolation. When wound onto the mandrel, the flat coil windings are formed into a compressed spiral loop where the number of loops is associated with the number of turns for the inductive device. The loop size for the flat coil winding is also variable although, in the illustrated embodiment, chosen so as to be of a sufficient size in order to receive the center post of the lower core element. Additionally, the flat coil windings 506 include terminal-receiving apertures 616 which are aligned to receive respective terminals 508 located on the header assembly 504.

The lower core element 512 as illustrated includes a flat bottom surface that is configured to sit on an opposing flat surface (not shown) of the header assembly, while the opposing interior surface includes two symmetrical riser elements and a cylindrical center post element 610 that protrudes from the geometric center of the lower core element. The riser elements are located at opposing edges and run the entire width of the lower core element. These riser elements also have a varying width with the central portion of the riser having the narrowest dimension with the riser gradually getting wider as you travel towards the edge of the riser elements. The center post element is configured to have the same height as the riser elements; however it is also envisioned that in certain embodiments, it may be desirable to include a reduced height for the center post (thereby creating a gap that allows for adjustment of the inductive characteristics of the device).

The upper core element 502, in the illustrated embodiment, is configured with flat external surfaces. The length and width dimensions of the upper core element are sized so as to match the respective dimensions of the lower core element. While a specific configuration is shown, it is appreciated that the illustrated configuration is merely exemplary. For example, and as discussed previously with respect to the embodiments illustrated in FIGS. 2-4, the upper and lower core element configurations could be swapped such that the lower core element is now the upper core while the upper core element becomes the lower core. Further core configurations, such as those described in co-owned U.S. Pat. No. 7,994,891 filed Oct. 1, 2009 and entitled "Stacked Inductive Device Assemblies and Methods", the contents of which were previously incorporated herein by reference in its entirety, could also be readily substituted in alternative embodiments. For example, while the embodiment of FIG. 6 only includes a pair of cores (i.e. upper core element 502 and lower core element 512), three (3) or more stacked cores could be incorporated with proper adaptation (such as lengthening terminals 508, etc.).

In the embodiment of FIGS. 5-6, the inductive device 500 includes seven (7) flat coil windings with three (3) primary windings and four (4) different secondary windings. Other variants that include one or more flat coil windings are of course also possible. In addition to having a single flat coil winding or multiple flat coil windings, each flat coil winding can also be varied so as to have a differing number of turns associated with it. For example, the primary flat coil winding might consist of ten (10) turns, while an associated secondary winding might only have five (5).

In addition to varying the number of flat coil windings and the number of turns within a given winding, the size of the windings can also be varied. For example, the primary winding could have a given width and thickness associated with that primary winding while the secondary winding might have the same thickness as the primary winding but have a differing width. Such a configuration might, for example, vary the capacitive characteristics of the underlying inductive device by varying the amount of overlap between a given primary winding and a given secondary winding. Furthermore, the placement of the flat coil windings can also be varied. For example, while the windings illustrated in FIG. 6 are positioned discretely from one another, the windings themselves could also be interleaved by, for example, winding the primary and secondary flat coil windings concurrently such that layers between the windings are interleaved between turns of the inductive device.

In the illustrated embodiment, the header assembly 504 is shaped to accommodate the profile of the lower core element 512. In addition, the header assembly 504 includes six (6) terminals 508, although it is appreciated that more or less terminals could be used depending on the needs of the inductive device application. The terminals also advantageously include spool head surface mount terminals which are configured for surface mounting the inductive device to a printed circuit board without increasing the overall footprint of the inductive device. However, it is appreciated that various other types of terminals could be substituted (e.g. gull wing surface mount terminals, through hole terminals, etc.) if desired. These and other embodiments would be readily apparent to one of ordinary skill given the present disclosure.

Exemplary Inductive Device Applications—

As previously discussed, the exemplary inductive devices described herein can be utilized in any number of different operational applications. In addition to power transformers with a single primary winding and one or more secondary windings, other possible electrical applications for the inductive devices described herein include, without limitation, isolation transformers, inductors, common-mode chokes, and switch-mode power transformers used, inter alia, in power supply applications. These and other inductive device applications would be readily apparent to one of ordinary skill given the present disclosure.

Methods of Manufacture—

Figure 7:
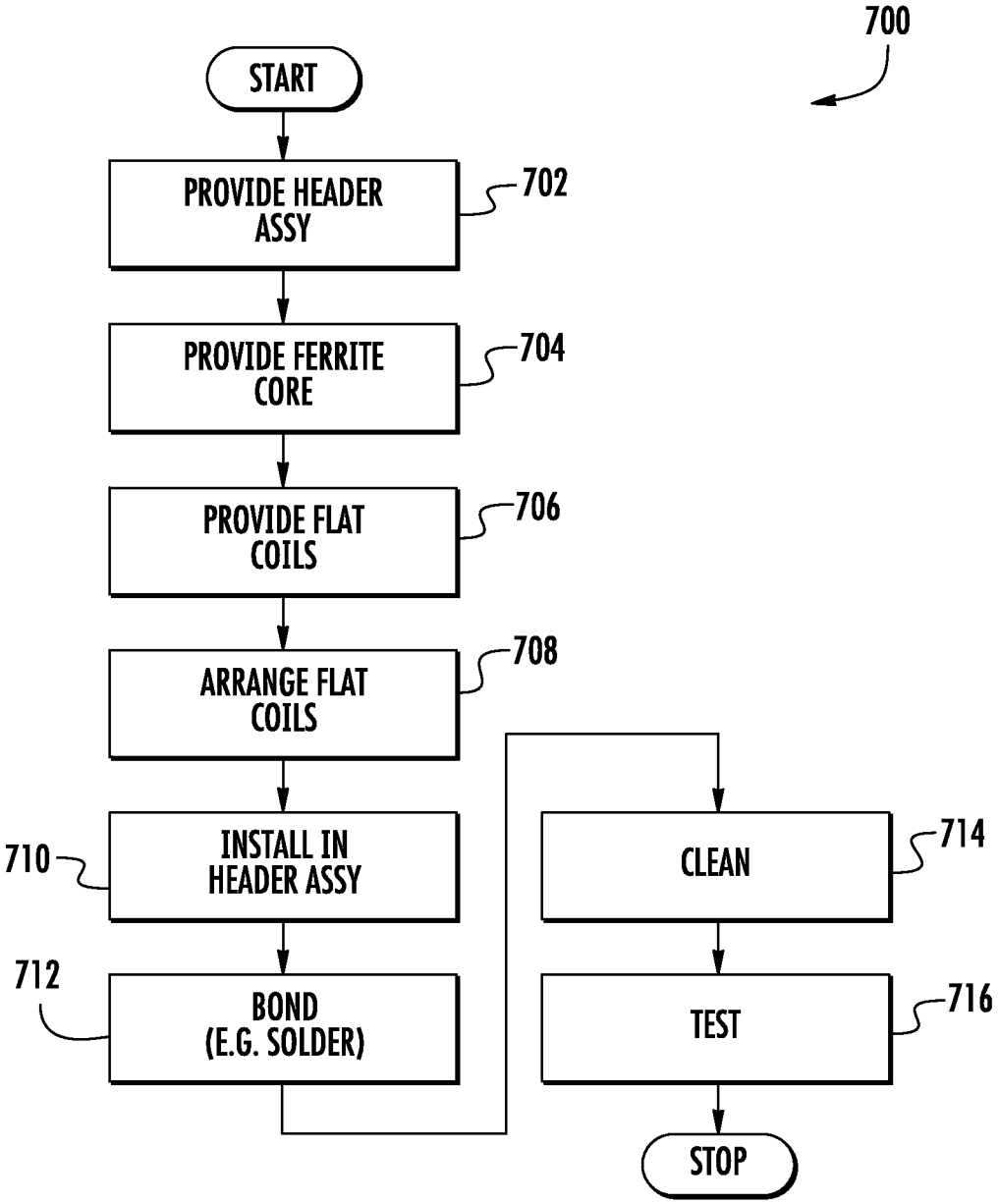
FIG. 7 is a flow chart diagram of an exemplary method of manufacture in accordance with one embodiment of the present disclosure.

Referring now to FIG. 7, an exemplary embodiment of a method 700 for manufacturing the inductive device of, for example, FIG. 4 is now described in detail. It will be recognized that while the following description is cast in terms of the device 400 of FIG. 4, the method is generally applicable to the various other configurations and embodiments of devices disclosed herein with proper adaptation, such adaptation being within the possession of those of ordinary skill in the electrical device manufacturing field when provided the present disclosure.

At step 702, a header assembly is provided. The header assemblies may be obtained by purchasing them from an external entity, or they can be indigenously fabricated by the assembler, or combinations of the foregoing. The exemplary header assembly is, as was previously discussed, manufactured using a standard injection molding process of the type well understood in the polymer arts, although other constructions and processes may be used. In addition, the header assembly will contain post pin terminals with the bottom of the pin terminals preferably formed to provide for a surface mount connection, although other types of surface mount or other mounting approaches may be used (e.g., through-hole terminals, self-leaded terminals, etc.).

At step 704, one or more upper core elements are provided. The cores may be obtained by purchase from an external entity, or fabricated in-house. Lower core elements are also provided or fabricated. The core components of the exemplary transformer described above is, in an exemplary embodiment, formed from a magnetically permeable material (e.g. Manganese-Zinc or Nickel-Zinc mixed with other materials) using any number of well understood processes such as pressing or sintering. The exemplary embodiment of the core is produced to have specific material-dependent magnetic flux properties, cross-sectional shape, riser dimensions, gaps, etc. as previously described herein.

At step 706, the flat coil windings are provided. In one embodiment, the flat coil windings are formed onto a mandrel and subsequently insulated as discussed previously herein. The flat coils can either be formed individually or in the alternative formed with multiple flat coils formed simultaneously. The flat coils are preferably a copper-based alloy flat wire, although other types of conductive materials may be used. After forming, the terminal apertures, intended to mate with their respective post pins on the header assembly, and optional notches are stamped into the flat coil windings. Alternatively, the terminal apertures and notches are stamped into the flat coil windings prior to being disposed and formed onto a mandrel.

At step 708, the flat coils are arranged together into the desired winding configuration(s). The arranged flat coils are ultimately placed onto the lower core element such that the center core element is received into the center opening of the flat coil windings. The upper core element is then disposed onto the lower core and mated thereto via an epoxy adhesive, mechanical means such as an external clip, etc.

At step 710, the assembled core and flat coil winding subassembly is then placed within the interior cavity of the header assembly such that the subassembly is resting upon the internal standoff features of the header assembly as shown in FIG. 3. The core assembly is then optionally secured to the header assembly using an adhesive or secured via a mechanical fit such as a press fit or snap feature (not shown). During installation the flat coil winding terminal apertures are arranged such that they mate with the respective terminal pins of the header assembly. The cores are also optionally bonded together using an epoxy adhesive. When bonded with an epoxy, one or more of a face-to-face bond or bridge bond is used to secure the cores to one another.

In an alternative arrangement, the lower core is first secured to the header assembly using, for example, an epoxy adhesive. The flat coil windings are then placed onto the bottom core and ranged such that the terminal apertures are received on the terminals. The upper core is then bonded to the lower core using an epoxy adhesive. One or more of a face-to-face bond or bridge bond is used to secure the cores to one another.

At step 712, the header assembly terminal pins and flat coil windings of the transformer subassembly are bonded. It is noted that such a process can also be used as an alternative to bonding the core assembly directly to the header assembly. In one embodiment, the bonding is performed using a standard eutectic solder. In an alternative embodiment, a conductive epoxy can be utilized at the terminal apertures of the flat coil windings thereby forming a mechanical and electrical connection with the terminal pins of the header assembly. In yet another alternative, the flat coil windings are secured to the terminal pins via a resistance welding technique.

At steps 714 and 716, the headers are optionally cleaned (e.g., for 2-5 minutes in either de-ionized water or isopropyl alcohol or another solvent) using an ultrasonic cleaning machine in order to remove chemicals and contaminants that can, for example cause degradation to the inductive device. The device is then marked (including product number and manufacturing code), tested if desired and subsequently reworked to correct any manufacturing defects that may be present. The devices are subsequently packaged for shipment on, preferably in a packaging form that facilitates automated handling such as tape and reel carriers and the like.

It will be recognized that while certain aspects of the disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure disclosed and claimed herein.

While the above detailed description has shown, described, and pointed out novel features of the disclosure as applied to various embodiments, it will be understood that various omissions, substitutions, and changes in the form and details of the device or process illustrated may be made by those skilled in the art without departing from the disclosure. The foregoing description is of the best mode presently contemplated of carrying out the disclosure. This description is in no way meant to be limiting, but rather should be taken as illustrative of the general principles of the disclosure. The scope of the disclosure should be determined with reference to the claims.

What is claimed is:

1. An inductive device, comprising:

a header assembly comprising a plurality of terminals;

at least one core;

one or more flat coil windings disposed in proximity to the at least one core and electrically coupled with respective ones of the terminals; and a notch located on at least one of the one or more flat coil windings, the notch comprising two or more angled surfaces, the notch configured to place the entirety of the at least one of the one or more flat coil windings further away from an adjacent terminal so as to reduce a high voltage potential shorting between the at least one of the one or more flat coil windings and the adjacent terminal;

wherein a first one of the one or more flat coil windings comprises a first rectangular terminal aperture located at a first level and a second rectangular terminal aperture located at a second level, a width of the first one of the one or more flat coil windings being substantially uniform over the entirety of the first one of the one or more flat coil windings; and wherein the first level resides at a different level than the second level within the inductive device.

2. The inductive device of claim 1, wherein the first terminal aperture is configured to receive a portion of a first terminal.

3. The inductive device of claim 2, wherein the second terminal aperture is configured to receive a portion of a second terminal.

4. The inductive device of claim 3, wherein the first terminal aperture is associated with a primary winding of a transformer and the second terminal aperture is associated with a secondary winding of the transformer.

5. The inductive device of claim 1, wherein at least a portion of the plurality of terminals comprise a chamfer feature.

6. The inductive device of claim 5, wherein the chamfer feature is configured to facilitate insertion of the respective terminal into a terminal aperture of the one or more flat coil windings.

7. The inductive device of claim 1, wherein the one or more flat coil windings comprises at least three discrete flat coil windings.

8. The inductive device of claim 1, wherein the header assembly further comprises:

a polymer carrier that defines a core receiving feature;

wherein the plurality of terminals each comprise a flat coil receiving end and a printed circuit board mating end.

9. The inductive device of claim 8, wherein the core receiving feature comprises a cavity, the cavity having one or more standoff features disposed therein.

10. The inductive device of claim 9, wherein the at least one core includes a standoff receiving feature, the standoff receiving feature sized to accommodate the one or more standoff features.

11. The inductive device of claim 8, wherein the flat coil receiving end comprises a vertically oriented terminal having a chamfered feature disposed thereon.

12. A flat coil winding, comprising:

a metal winding comprising a width and a thickness, the width being greater in dimension than the thickness, the metal winding further comprising one or more elongated terminal receiving apertures disposed at one or more ends of the metal winding; and a notch comprising two or more angled surfaces, the notch configured to provide an additional distance between the entirety of the metal winding and an adjacent terminal on an inductive device to which the flat coil winding is ultimately positioned and reduce high potential shorting between the metal winding and the adjacent terminal;

wherein the metal winding is wound into a spiral of two or more loops characterized by an inner radius and an outer radius where a difference between the outer radius and the inner radius is the width; and wherein the width of the metal winding at the one or more ends is substantially the same as the width of the metal winding at the two or more loops.

13. The flat coil winding of claim 12, wherein the one or more terminal receiving apertures are substantially rectangular in shape.

14. An electronics assembly comprising:

a power source;

a printed circuit board; and an inductive device mounted on the printed circuit board that is in electrical communication with the power source, the inductive device comprising:

a header assembly comprising a plurality of terminals;

at least one core;

two or more flat coil windings each comprising a plurality of turns and one or more rectangular terminal apertures disposed at one or more ends of the respective flat coil winding, the two or more flat coil windings interleaved with each other and disposed in proximity to the at least one core and electrically coupled with respective ones of the plurality of terminals; and a notch located on at least one of the two or more flat coil windings, the notch comprising a plurality of surfaces that are angled with respect to one another, the notch configured to place the entirety of the at least one of the two or more flat coil windings further away from an adjacent terminal to reduce high voltage potential shorting between the at least one of the two or more flat coil windings and the adjacent terminal;

wherein a width of the two or more flat coil windings at the one or more ends is substantially the same as a width of the two or more flat coil windings at a turn thereof.

15. The electronics assembly of claim 14, wherein the inductive device is configured to provide a lower direct current resistance than a comparable inductive device comprised of printed circuit board windings.

* * * * *